United States Patent [19]

Marchetti

[11] Patent Number: 4,855,006

[45] Date of Patent: Aug. 8, 1989

[54] TAPPING UNIT FOR A SEALING MACHINE FOR CARDBOARD BOXES, EQUIPPED WITH A CONTROL SYSTEM FOR SIGNALLING THE ABSENCE OF TAPE SUPPLIED TO THE BOXES TO BE SEALED

[76] Inventor: Augusto Marchetti, Via Caccialepori, 35 - 20148 Milan, Italy

[21] Appl. No.: 178,374

[22] Filed: Apr. 6, 1988

[30] Foreign Application Priority Data

Apr. 14, 1987 [IT] Italy ..... 20109 A/87

[51] Int. Cl.[4] ..... B65H 63/02

[52] U.S. Cl. ..... 156/378; 156/352; 156/468; 156/486; 242/57

[58] Field of Search ..... 156/468, 475, 486, 350, 156/361, 365; 242/57

[56] References Cited

U.S. PATENT DOCUMENTS 2,590,518 3/1952 Duncan et al. ..... 242/57 X

FOREIGN PATENT DOCUMENTS 58-53814 3/1983 Japan ..... 242/57

61-114955(A) 2/1986 Japan ..... 242/57

*Primary Examiner*—David Simmons

*Attorney, Agent, or Firm*—Cushman, Darby & Cushman

[57] ABSTRACT

A taping unit, included in a taping machine for sealing cardboard boxes, equipped with a control system of the tape supplied to a box to be sealed. The control system is of the pneumatic type and includes a timer piloted by a sensitive member which works together with a cam-shaped element rotated by the tape and formed so as to cause the commutation of the sensitive member at least once for each rotation of the cam-shaped element. The timer is adjusted so as to generate a warning signal on each occasion on time interval goes by that is longer than a predetermined limit between one commutation of the sensitive member and the next. The warning signal can be used to cause stoppage of the machine.

7 Claims, 6 Drawing Sheets

TAPPING UNIT FOR A SEALING MACHINE FOR CARDBOARD BOXES, EQUIPPED WITH A CONTROL SYSTEM FOR SIGNALLING THE ABSENCE OF TAPE SUPPLIED TO THE BOXES TO BE SEALED

BACKGROUND OF THE INVENTION

The present invention relates to a taping unit in a sealing machine for cardboard boxes, equipped with a control system for signalling the absence of tape for sealing the boxes.

As is well known, taping machines for sealing cardboard boxes include a bed with means for advancing the boxes as well as taping units for applying a strip of tape to the top and to the bottom of the box.

Each taping unit (see, for example, application No. 23191 A/84 by the same applicant) is equipped with a support roller for the roll of adhesive tape, other support rollers for the tape and rollers for applying the tape on the box. Said rollers for applying the tape are inserted on pivots fixed to arms which are elastically movable to follow the contour of the moving box and press the applied tape to it. The tape is unwound from the roll by the movement of the box and is cut at an appropriate distance by means of a cutting member which operates after the rear end of the box has passed a certain point.

If the tape breaks at any point along its path, the box which is passing the taping machine at that instant will be only partially sealed while the subsequent boxes will not be sealed at all. It is therefore necessary to act promptly by stopping the machine and restoring its correct operation.

It follows that there will be a loss of time and an additional inconvenience for the operator because the boxes which have already passed the machine without being sealed must be taken back upstream from the taping machine.

The same defect occurs when the roll of tape finishes or with any other problem connected with the tape feed.

SUMMARY OF THE INVENTION

The object of the present invention is to control the tape supplied to the taping units of a taping machine, so that it is possible to act by stopping the machine if for any reason the tape feed ceases.

According to the invention, such object is attained by a taping unit included in the taping machine for sealing cardboard boxes, said unit including a support roll for a roll of adhesive tape, support rollers for the tape and rollers for applying the tape on the box, characterized in that it includes means sensitive to the passage of the tape from said support roller to said rollers for applying the tape and a control system which generates a warning signal for a tape stoppage indicating device each time such sensitive means signal a stoppage of the tape feed.

Preferably said sensitive means are constituted by a pneumatic valve associated with a cam-shaped element rotated by the tape and formed so as to cause the commutation of said pneumatic valve at least once for each rotation of said cam element and said control system includes a timer piloted by said pneumatic valve so as to generate said warning signal on each occasion a time interval goes by that is longer than a predetermined limit between one commutation and the next of said pneumatic valve.

BRIEF DESCRIPTION OF THE DRAWINGS

One possible embodiment of the present invention is illustrated as a non-limiting example in the enclosed drawings, in which.

DETAILED DESCRIPTION

Figure 1:
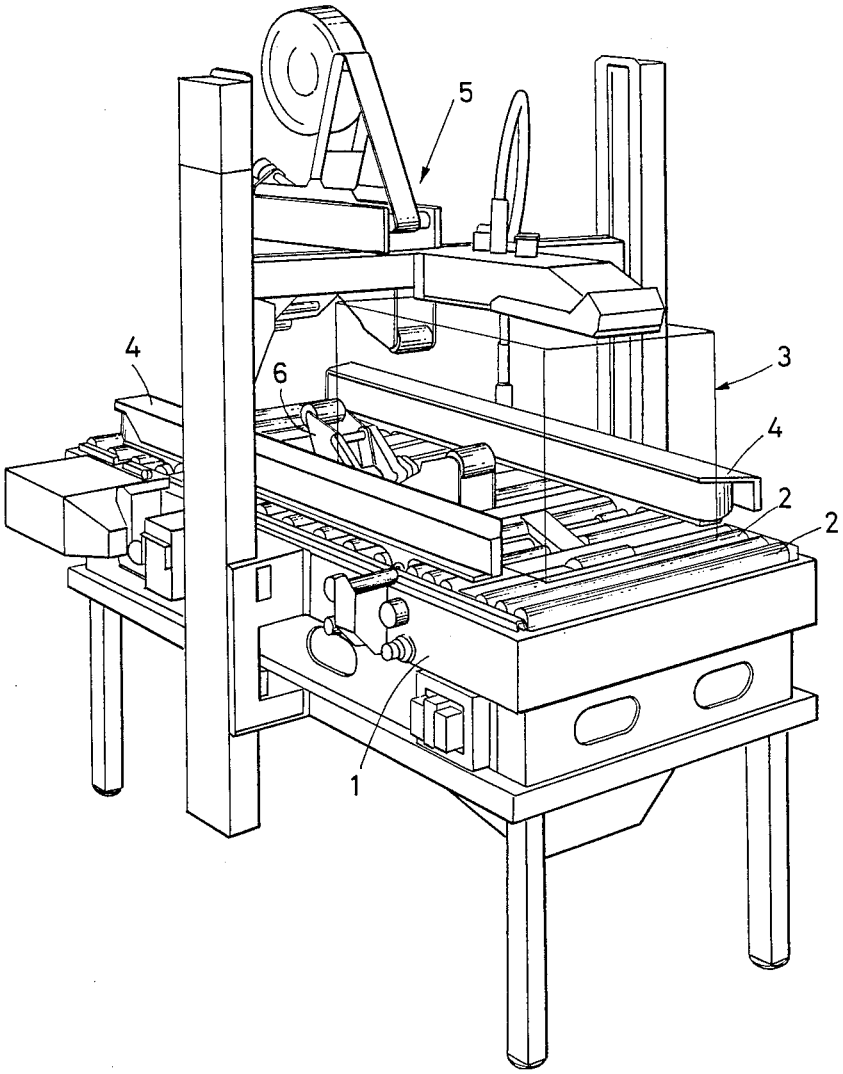
FIG. 1 shows a perspective view of a taping machine equipped with two taping units.

With reference to FIG. 1, the taping machine illustrated includes a bed 1 equipped with idle rollers 2 on which the box 3 slides as it is moved by the feed means 4, an upper taping unit 5 and a lower taping unit 6. Said taping units are the same and each is equipped with a tape feed control system.

Figure 2:
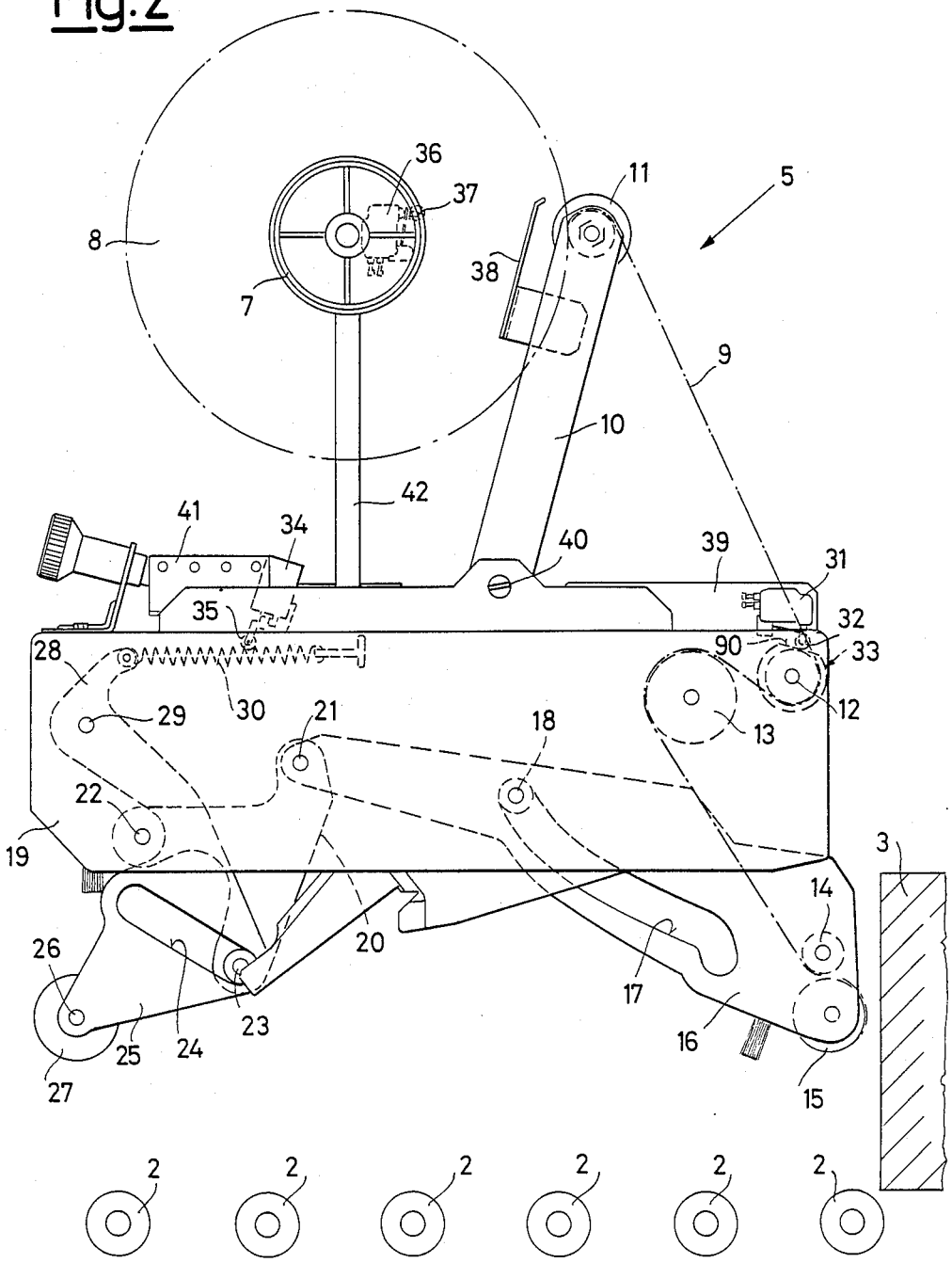
FIG. 2 shows a lateral view of a taping unit at rest with a control system according to the invention.
Figure 3:
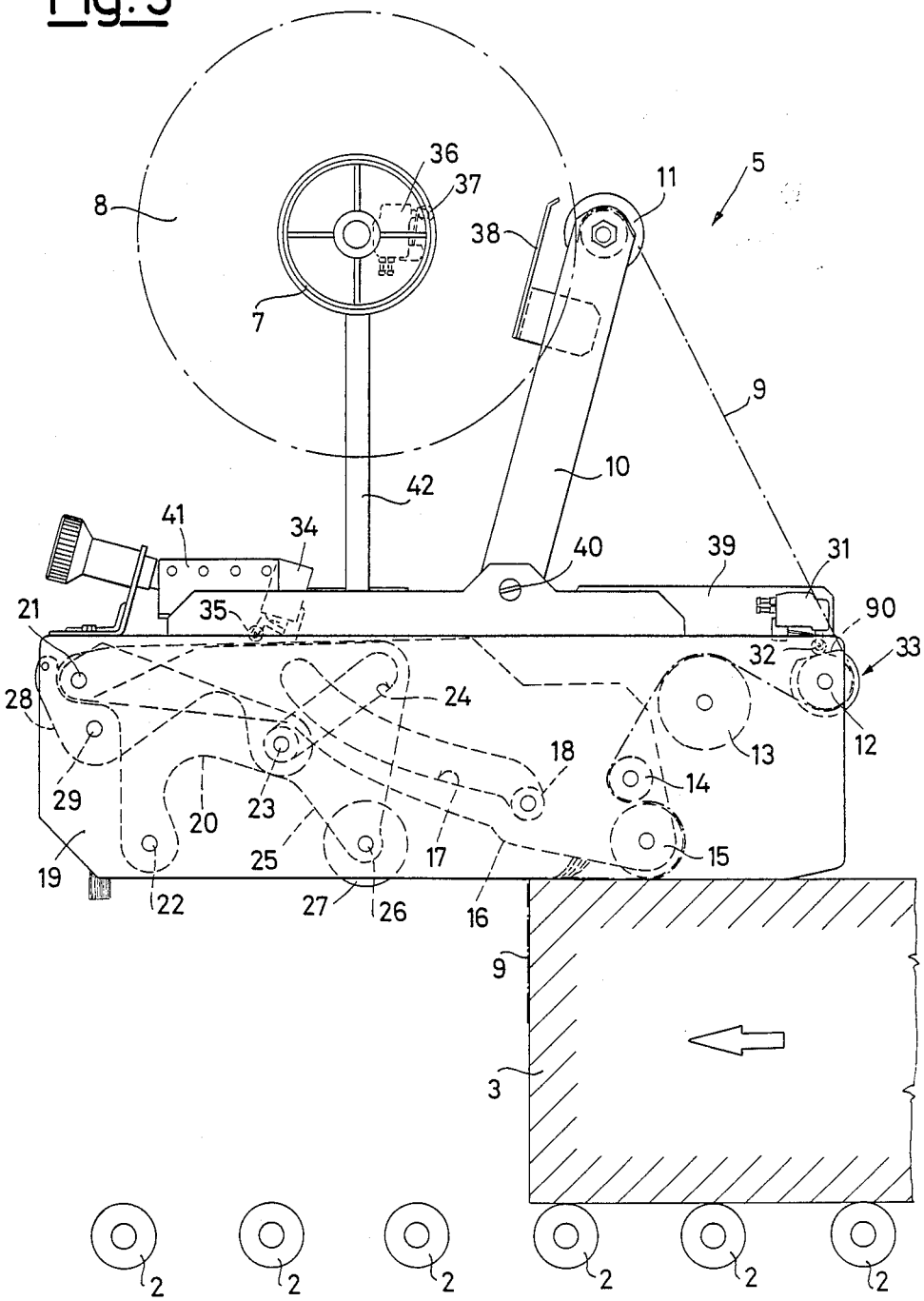
FIG. 3 shows a lateral view of the above taping unit in the box sealing phase.
Figure 4:
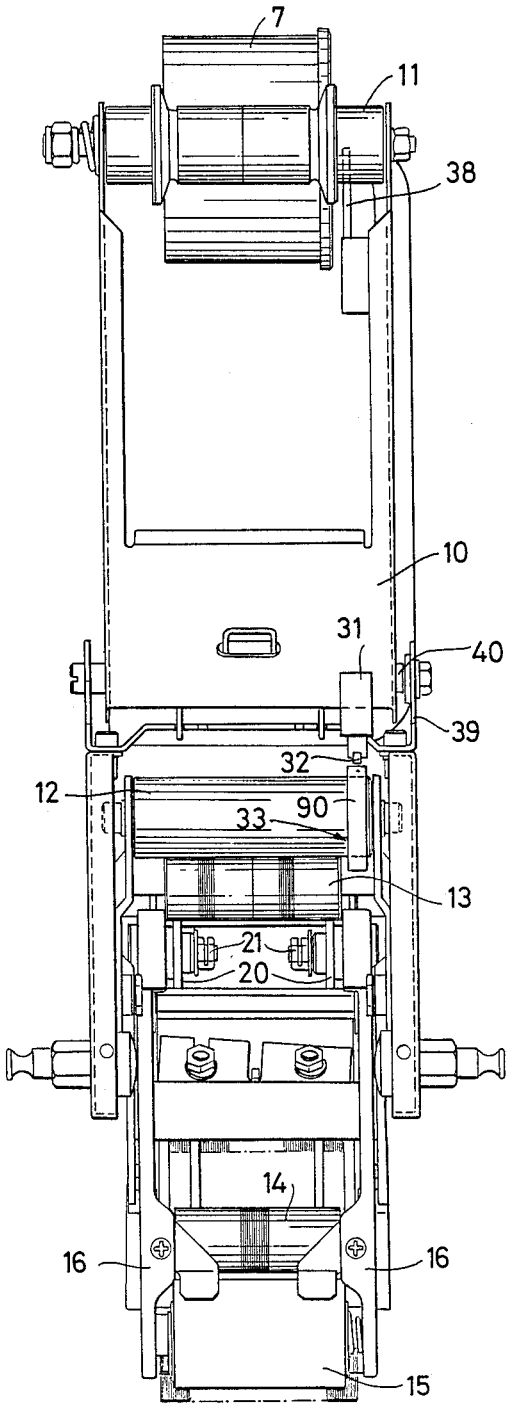
FIG. 4 shows a lateral view of the above unit from the right with respect to FIG. 2.
Figure 5:
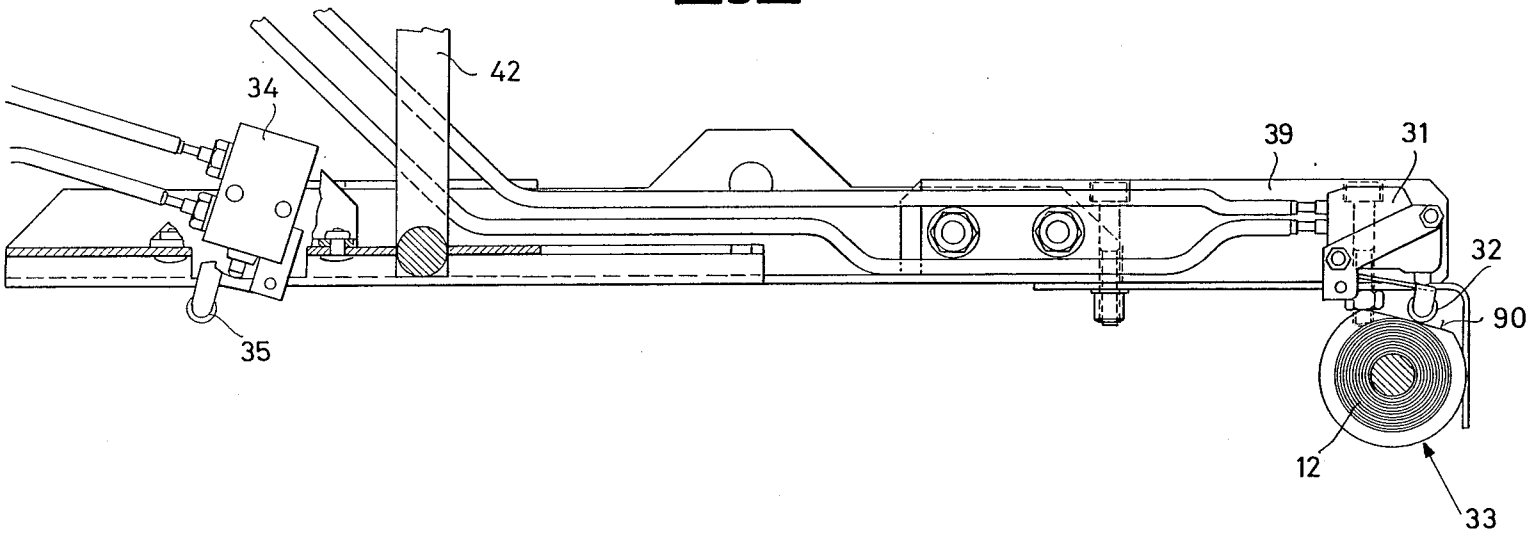
FIG. 5 shows a detail of said control system.

FIG. 2 shows the upper taping unit 5, which on an arm 42 carries a rotating support roller 7 for the roll 8 of tape 9 and arms 10 which support a rotating tape tension roller 11. The arms 10 are kept in contact with the outside of the roll 8 and rotate with the decrease in thickness of the roll due to the fact that they are spring-hinged at 40.

The tape is fed by means of support rollers 12, 13 and 14 to a first roller 15 for applying the tape supported at the ends of arms 16 equipped with slots 17 which form the sliding guides of a fixed pivot 18 supported by the side walls 19 of the taping unit's frame. Each of the other ends of arms 16 is hinged at 21 to the first arm of a T-lever 20 which rotates on a pivot 22 fixed to the walls 19 and passing through the end of a second arm of said lever. The third arm of each T-lever is equipped with a hub 23 which slides in the slots 24 obtained in a pair of arms 25 supporting a pivot 26 on which a second roller 27 for applying the tape is inserted. The arms 25 are integral with the crank arms 28 hinged at 29 and subjected to the action of a spring 30.

As can be seen from FIGS. 2 to 5, the taping unit 5 is equipped with a first mechanically-controlled pneumatic valve 31, with a probe 32 which engages a cam-shaped element 33 integral with the support roller 12 for the tape 9, with a second mechanically-controlled pneumatic valve 34, with a probe 35 which engages one of the movable arms 16 when a box 3 advances along the path of the taping unit and produces the return of said arms within the walls 19 of the unit's frame, and lastly with a third mechanically-controlled pneumatic valve 36 with a probe 37 which comes into contact with a rod 38 integral with one of the supporting arms 10 of the tension roller 11 when the tape roll 8 is almost finished.

As shown in FIGS. 2, 3, 4 and 5, valves 31 and 34, together with a control box 41, are fixed to a movable frame 39 which in turn is mounted on the side walls 19 of the taping unit so that the control system can be easily dismantled both for maintenance of the system itself, and for gaining access to the inner parts of the taping unit for repairs, maintenance, etc..

Valve 36 is fixed to support roller 7 of tape roller 8 and this is therefore also easily detachable.

Figure 6:
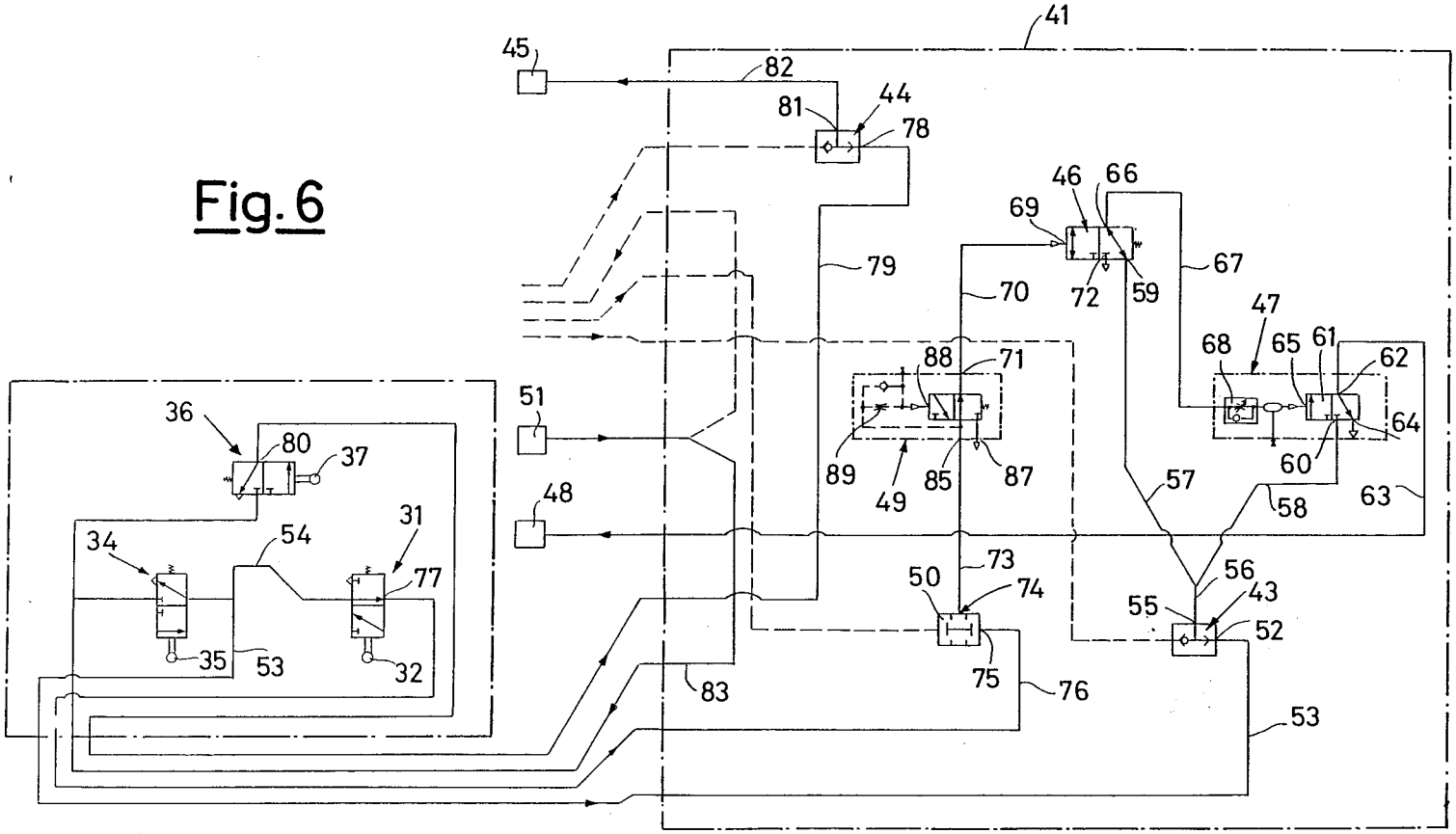
FIG. 6 shows the pneumatic diagram of said control system.

The control box 41 is of the pneumatic type and, as shown in FIG. 6, includes a first selection valve 43, a second selection valve 44 which communicates with a tape-finished signalling device 45, a pneumatically-controlled pneumatic valve 46, a timer 47 connected to a tape-broken signalling device 48, an impulse shaper 49 and, if required, a connecting element 50 for connecting a second set of mechanically-controlled pneumatic valves (not shown) belonging to the second taping unit 6.

An air supply 51 maintains the system at the operating pressure.

The first selection valve 43 has an input 52 communicating by means of a conduit 53 with a conduit 54 which connects together the valves 31 and 34, and has an output 55 connected to a conduit 56 with two branches 57 and 58 which terminate at a first input 59 of the pneumatic valve 46 and at a second input 60 of a second pneumatically-controlled pneumatic valve 61 included in timer 47, respectively.

Output 62 of said valve 61 is connected by means of a conduit 63 to the tape-broken signalling device 48. Said valve 61 is in addition equipped with a vent 64 normally connected to said output 62, said vent being excluded when the pressure at a pilot input 65 of said valve produces the commutation of the valve itself to establish a communication between the input 60 and output 61, so that the signalling device 48 is activated.

Input 65 of valve 61 is connected to output 66 of the first pneumatic valve 46 by means of a conduit 67 on which a pressure regulator 68 is inserted.

The first pneumatic valve 46 has a pilot input 69 which communicates by means of a conduit 70 with output 71 of the impulse shaper 49, and it also has a vent 72 which is connected with conduit 67 excluding the connection with conduit 57 when the impulse shaper 69 sends a pressure impulse to valve 46.

The impulse shaper 49 includes a pneumatic valve 86, which alternatively connects output 71 either to input 85 or to vent 87 according to the pressure state at a pilot input 88 connected to input 85 by means of the pressure reducer 89.

Input 85 of the impulse shaper is connected by conduit 73 to output 74 of the connecting element 50 whose input 75 is connected by means of a conduit 76 to output 77 of valve 34 which signals tape breakages.

Lastly the second selection valve 44 has an input 78 connected by a conduit 70 to output 80 of the mechanically-controlled valve 36 which signals the end of the tape and has an output 81 connected by a conduit 82 to the tape-finished signalling device 45.

The power supply unit 51 keeps the system's operating pressure at its correct level by supplying valves 31, 34 and 36 by means of conduit 83.

The connecting conduits indicated by a dotted line in FIG. 6 refer to mechanically-controlled pneumatic valves similar to valves 31, 34 and 36, on the second taping unit 6 installed on the taping machine.

Each taping unit equippped with the control system described above operates as follows.

When the machine is empty valve 34 keeps the control circuit 41 with no pressure and thus at rest as shown in FIG. 6, so that the signal arrives at the signalling devices 45 and 48.

When a box 3 arrives at the taping machine it is gripped at its sides by the feed means 4 and moved through the taping units. On each unit the box 3 intercepts the roller 15 for applying the tape on which the tape 9 passes and thus adheres to the front side of the box, then the box 3 presses against the roller 15 and forces its supporting arms 16 to move towards the internal part of the walls 19 of the taping unit while tape 9 is unwound from roll 8 and, carried by the box, induces the rotation of supporting rollers 12, 13 and 14. One of the two arms 16 reaches probe 35 of valve 34 which enables the connection with the pneumatic circuit downstream; in fact the pressure passes from feed conduit 83 to conduit 53 and from this to the first selection valve 43 which puts conduits 57 and 58 under pressure. By means of the pneumatically-controlled valve 46 such pressure is fed to conduit 67 and then through regulator 68 to the pilot input 65 of valve 61 of timer 47; the timer's pilot pressure thus rises progressively towards a value which is appropriate to cause the commutation of valve 61. As already said, tape 9 has simultaneously induced the rotation of roller 12, together with the cam-shaped element 33 which engages probe 32 of the mechanically-controlled valve 31. During the time in which the probe 32 engages the round part of the cam-shaped element 33, said valve 31 is kept closed so that the pressure arriving from conduit 54 does not pass to conduit 76, whereas each time probe 32 meets the flat part 90 of said element 33, valve 31 enables the connection between the two conduits 54 and 76 so that pressure reaches the impulse shaper 49 which will send a pressure impulse to input 69 of the pneumatically-controlled valve 46. This impulse controls the connection of conduit 67 with the discharge 72, thus causing the discharge of the pilot pressure applied to input 65 of valve 61. Since the impulse coming from the shaper 49 is of limited duration, when it ceases valve 46 restores the connection between conduit 67 and conduit 57, so that a new loading cycle of timer 47 begins. Probe 32 of valve 31 in the meantime abandons the flat part 90 and valve 31 is once again closed. During the sealing of one box several cycles take place in which air is charged and discharged under pressure at the pilot input of timer 47.

If the tape breaks accidentally, or if the free end of the tape is not properly positioned on the roller 15 for applying the tape at the start of the sealing cycle, roller 12 no longer rotates, and thus stops the cam-shaped element 33 with probe 32 on the round part or on the flat portion 90 of the cam-shaped element. In the first case, the connection between conduit 54 and conduit 76 is interrupted, so that the pressure upstream from valve 31 does not reach the impulse shaper 49, while if a case is present air under pressure is continuously fed to selection valve 43 and thus by means of connection 57 to valve 46 and from this by means of conduit 67 to the pilot input 65 of valve 61.

When the pressure at inlet 65 is higher than a predetermined value, valve 61 commutates and activates the connection between conduit 58 and conduit 63 and air under pressure arrives at the signalling device 48, which issues a warning signal and, if required, orders the stoppage of the taping machine.

In the case where probe 32 stops on the flat part 90 of the cam-shaped element 33, the permanent connection is established between the pressure upstream from valve 31 and impulse shaper 49. The latter, even if a constant pressure is present, produces a single impulse enables a single discharge cycle of conduit 67 in accordance with the above description, after which if a case is present pressure increases in conduits 53, 57 and 67 until the moment when valve 61 of the timer trips into the connection position between conduits 58 and 63 and causes a similar tape breakage warning at the signalling device 48.

If the tape is finished contact is established between the rod 38 mounted on a supporting arm 10 of the tension roller 11 and probe 37 of valve 36. Such contact enables the connection between the input of valve 36 and conduit 79 connecting with the second selection valve 44, which transmits the pressure to the signalling device 45 by means of conduit 82.

Preferably the contact between the rod 38 and probe 37 occurs when the tape is not completely finished signalling the end of the tape in good time so that the operator can prepare for the tape roll change and restore the operation of the taping machine as soon as possible.

I claim:

1. A taping unit for a cardboard box sealing machine, including:

a support roller for a roll of adhesive tape; tape supporting rollers and rollers for applying the tape on the box; means which are sensitive to the passage of the tape from said support roller to said rollers for applying the tape; a control system which can generate a warning signal for a tape stoppage warning device each time that such sensitive means signal a stoppage in the tape feed;

said sensitive means being constituted by a cam sensing means associated with a cam-shaped element rotated by the tape and formed so as to cause the commutation of said cam sensing means at least once for each rotation of said cam-shaped element;

said control system including:

a timer piloted by said cam sensing means so as to generate said warning signal on each occasion a time interval goes by that is longer than a predetermined limit between one commutation and the next of said cam sensing means.

2. A taping unit according to claim 1, characterized in that said control system includes an impulse shaper placed between said cam sensing means and said timer to convert each commutation of said first valve away from a predetermined position into a resetting impulse of said timer.

3. A taping unit according to claim 2, wherein:

said cam sensing means comprises a pneumatic valve.

4. A taping unit according to claim 1, wherein:

said cam sensing means comprises a first pneumatic valve.

5. A taping unit according to claim 4, characterized in that it also includes a second pneumatic valve sensitive to the passage of a box, said second pneumatic valve being associated with said control system so as to control the compressed air feed to the control system itself.

6. A taping unit according to claim 5, characterized in that it also includes a third pneumatic valve arranged so that it is sensitive to the end of the tape in the taping unit, said third valve being placed between an air supply to the control system and a tape-end signalling device.

7. A taping unit according to claim 6, characterized in that said pneumatic valves and said control system are mounted on a removable frame loosely attached to a body of the taping unit.

* * * * *